US008903100B2

(12) United States Patent
Hiraki

(10) Patent No.: US 8,903,100 B2
(45) Date of Patent: Dec. 2, 2014

(54) LOUDSPEAKER CONTROL APPARATUS AND METHOD FOR INSPECTING LOUDSPEAKER

(75) Inventor: Tatsushi Hiraki, Osaka (JP)

(73) Assignee: Panasonic Corporation, Kadoma-shi (JP)

( * ) Notice: Subject to any disclaimer, the term of this patent is extended or adjusted under 35 U.S.C. 154(b) by 246 days.

(21) Appl. No.: 13/327,720

(22) Filed: Dec. 15, 2011

(65) Prior Publication Data

US 2012/0263309 A1 Oct. 18, 2012

(30) Foreign Application Priority Data

Apr. 13, 2011 (JP) ..... 2011-089599

(51) Int. Cl.
*H04R 29/00* (2006.01)
*H04R 27/00* (2006.01)

(52) U.S. Cl.
CPC ..... *H04R 29/001* (2013.01); *H04R 27/00* (2013.01)
USPC ..... 381/59; 381/56; 381/58; 381/303; 324/500; 324/501

(58) Field of Classification Search
USPC ..... 381/56, 58, 59, 303; 324/500, 501
See application file for complete search history.

(56) References Cited

U.S. PATENT DOCUMENTS

2009/0304194 A1* 12/2009 Eggleston et al. ..... 381/59

FOREIGN PATENT DOCUMENTS

| | | | |
|---|---|---|---|
| JP | 2006-270843 | A | 10/2006 |
| JP | 2006-279755 | A | 10/2006 |
| JP | 2007-068101 | A | 3/2007 |
| JP | 2007-228401 | A | 9/2007 |

* cited by examiner

*Primary Examiner* — Paul S Kim
(74) *Attorney, Agent, or Firm* — James W. Judge

(57) ABSTRACT

A loudspeaker control apparatus of the present invention includes: an operation reception section that receives a user operation; a mode selection section that selects between two operation modes, based on the user operation, either a normal mode in which operations of a plurality of loudspeakers and lights are controlled independently or an inspection mode in which each of the plurality of loudspeakers is inspected to see whether it is operating normally; and a control section that controls the operations of the plurality of loudspeakers and lights based on the operation mode, and the control section, in the inspection mode, sequentially causes the plurality of loudspeakers to output an inspection tone and sequentially causes lights which correspond to the loudspeakers from which the inspection tone is being outputted to be turned on or to blink.

6 Claims, 7 Drawing Sheets

LOUDSPEAKER INSPECTING METHOD 500

FIG. 4

| ORDER OF INSPECTION | TRANSMISSION DESTINATION OF IP ADDRESS | IP ADDRESS | LOUDSPEAKER TO BE INSPECTED | PORT ID | CALL LIGHT TO BE TURNED ON | PORT ID |
|---|---|---|---|---|---|---|
| 1 | FIRST DRIVING SECTION 311 | 192.168.0.1 | FIRST LOUDSPEAKER 101 | 1 | FIRST CALL LIGHT 201 | 101 |
| 2 | SECOND DRIVING SECTION 312 | 192.168.0.2 | SECOND LOUDSPEAKER 102 | 2 | SECOND CALL LIGHT 202 | 102 |
| 3 | THIRD DRIVING SECTION 313 | 192.168.0.3 | THIRD LOUDSPEAKER 103 | 3 | THIRD CALL LIGHT 205 | 105 |
| ... | ... | ... | ... | ... | ... | ... |
| N | N-TH DRIVING SECTION | 192.168.0.n | N-TH LOUDSPEAKER | N | N-TH CALL LIGHT | NNN |

LOUDSPEAKER CONTROL APPARATUS AND METHOD FOR INSPECTING LOUDSPEAKER

BACKGROUND OF THE INVENTION

1. Field of the Invention

The present invention relates to loudspeaker control apparatuses and methods for inspecting loudspeakers, and more particularly to loudspeaker control apparatuses and methods for inspecting loudspeakers, for allowing an inspector to perceive whether the loudspeakers are operating normally.

2. Description of the Background Art

For loudspeakers which are provided in a room or the like, there is a need for inspection to see whether the loudspeakers are operating normally. For example, Patent Literature 1 discloses a technology in which a surface of a vibrating section of a loudspeaker is irradiated with non-diffused light and an inspector checks a part of the surface of the vibrating section irradiated with the non-diffused light, thereby inspecting whether the loudspeaker is operating normally.

[Patent Literature 1] Japanese Laid-Open Patent Publication No. 2006-279755

In the conventional inspecting method disclosed in Patent Literature 1; however, although it is possible to detect a loudspeaker which is not operating normally immediately after manufacture or before shipment (immediately prior to factory shipment) of the loudspeaker, there is a problem that once a plurality of loudspeakers are provided in a room or the like, for example, it is not easy to inspect whether the loudspeakers are operating normally.

Specifically, in the conventional inspecting method, with respect to each of a plurality of loudspeakers provided in a room or the like, a light source is required for irradiating a surface of a vibrating section of the loudspeaker with non-diffused light in such a manner that the non-diffused light is incident perpendicular to the surface. In other words, light sources which correspond to the respective loudspeakers are required, and a surface of a vibrating section of each loudspeaker needs to be irradiated with non-diffused light at a predetermined angle. For this reason, it is difficult for an inspector to check, with respect to each of the plurality of loudspeakers provided in the room or the like, whether the loudspeaker is operating normally. Furthermore, there is a case where the inspector cannot inspect the loudspeaker depending on its location.

SUMMARY OF THE INVENTION

Therefore, an objective of the present invention is to provide, for a plurality of loudspeakers provided in a room or the like, a control apparatus and a method which do not require a light source or the like for inspection, for easily inspecting whether the respective loudspeakers are operating normally in a short time even after the loudspeakers are provided in the room or the like.

In order to achieve the above objective, a loudspeaker control apparatus of the present invention which controls operations of a plurality of loudspeakers and lights provided indoors, includes: an operation reception section that receives a user operation: a mode selection section that selects between two operation modes, based on the user operation received by the operation reception section, either a normal mode in which the operations of the plurality of loudspeakers and lights are controlled independently or an inspection mode in which each of the plurality of loudspeakers is inspected to see whether it is operating normally; and a control section that controls the operations of the plurality of loudspeakers and lights based on the operation mode selected by the mode selection section, and the control section, in the inspection mode, sequentially causes the plurality of loudspeakers to output an inspection tone and, in accordance with the inspection tone being outputted, sequentially causes lights which correspond to the loudspeakers from which the inspection tone is being outputted to be turned on or to blink.

In order to achieve the above objective, a loudspeaker inspection method of the present invention is performed by a loudspeaker control apparatus that controls operations of a plurality of loudspeakers and lights provided indoors, including the steps of: receiving a user operation; selecting between two operation modes, based on the user operation received in the user operation receiving step, either a normal mode in which the operations of the plurality of loudspeakers and light are controlled independently or an inspection mode in which each of the plurality of loudspeakers is inspected to see whether it is operating normally; and controlling the operations of the plurality of loudspeakers and lights based on the operation mode selected in the operation mode selecting step, and the controlling step, in the inspection mode, sequentially causes the plurality of loudspeakers to output an inspection tone and, in accordance with the inspection tone being outputted, sequentially causes lights which correspond to the loudspeakers from which the inspection tone is being outputted to be turned on or to blink.

Further, in order to achieve the above objective, the process steps performed by the respective components of the loudspeaker control apparatus of the present invention may be viewed as a loudspeaker inspection method which provides a series of procedures. This method is provided in a form of a program to cause a computer to perform the series of procedures. The program may be recorded in a computer-readable recording medium to be introduced to the computer.

As described above, according to the loudspeaker control apparatus and the loudspeaker inspection method of the present invention, it is possible, for a plurality of loudspeakers provided in a room or the like, to not require a light source or the like for inspection, and to easily inspect whether the respective loudspeakers are operating normally in a short time even after the loudspeakers are provided in the room or the like.

BRIEF DESCRIPTION OF THE DRAWINGS

FIG. 4 shows an example of a database in which an association between the loudspeakers and the call lights is stored;

DESCRIPTION OF THE PREFERRED EMBODIMENTS

Hereinafter, one embodiment of the present invention will be described with reference to the drawings.

Figure 1:
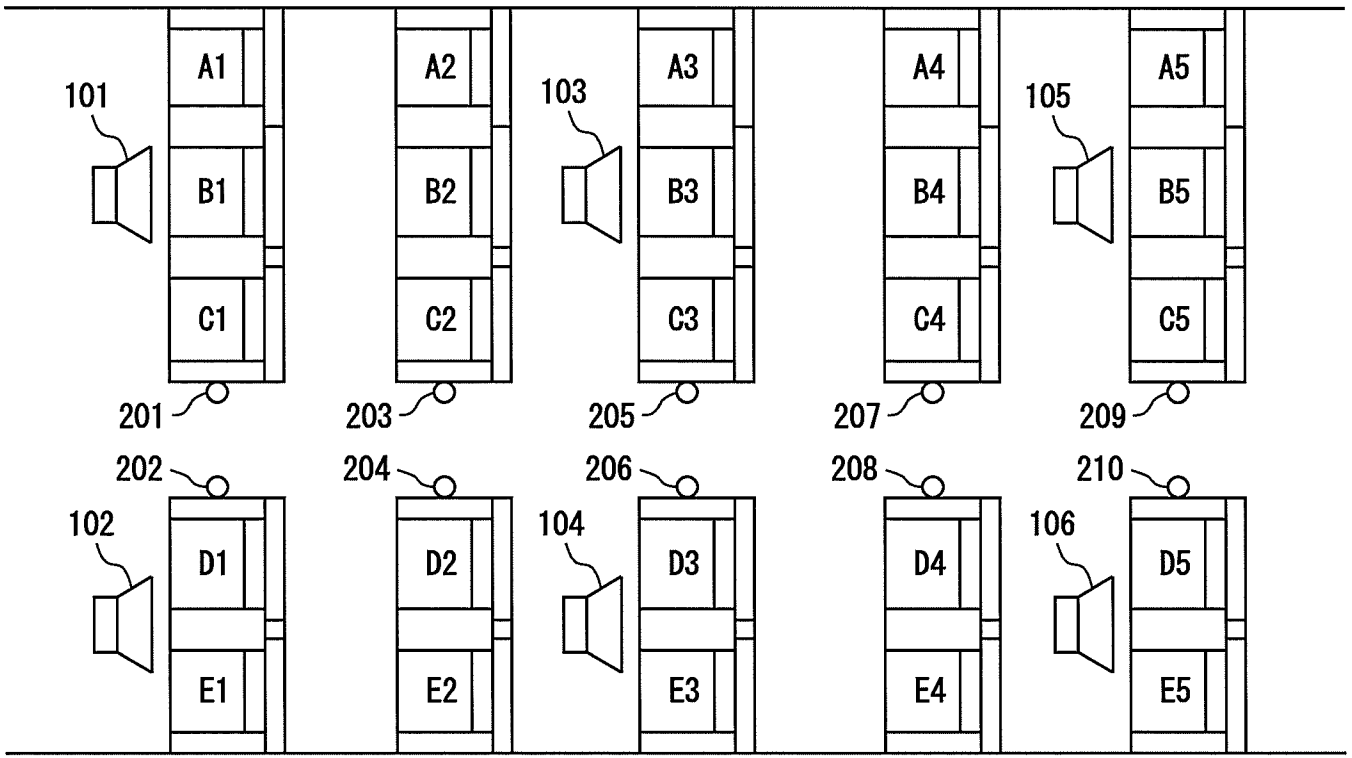
FIG. 1 is a schematic diagram showing an arrangement example of seats, loudspeakers, and call lights in an airplane.

FIG. 1 is a schematic diagram showing an arrangement example of seats, loudspeakers, and call lights in an airplane. In FIG. 1, seats A1 to E5 are provided, and first to sixth loudspeakers 101 to 106 and first to tenth call lights 201 to 210 are further arranged in the airplane.

In the seats A1 to E5, passengers are respectively seated.

From the first to the sixth loudspeakers 101 to 106, a sound such as an in-flight announcement, a chime sound for calling attention, and the like are outputted.

For example, the seats A1 to E5 are provided with call buttons, respectively, and when a passenger presses the call button, a corresponding one of the first to the tenth call lights 201 to 210 is turned on. In this case, one call light is provided for every predetermined number of seats. For example, when any one of passengers seated in the seats A1, B1, and C1 presses the call button, the first call light 201 is turned on. Consequently, crew members can perceive that one of the passengers seated in the seats A1, B1, and C1 has pressed the call button. Likewise, when either of passengers seated in the seats D1 and E1 presses the call button, the second call light 202 is turned on. Consequently, the crew members can perceive that one of the passengers seated in the seats D1 and E1 has pressed the call button. The third to the tenth call lights 203 to 210 function in the same manner.

What has been described thus far is a normal mode in which the loudspeakers and the call lights provided in the airplane operate independently. In other words, the loudspeakers provided in the airplane output a sound such as an in-flight announcement, a chime sound for calling attention, and the like, and the first to the tenth call lights 201 to 210 are turned on when passengers press corresponding call buttons. Accordingly, the loudspeakers and the call lights 201 to 210 function independently of each other.

Next, an inspection mode in which the first to the sixth loudspeakers 101 to 106 provided in the airplane are inspected to see whether they are operating normally will be described in detail. In the inspection mode, the respective first to sixth loudspeakers 101 to 106 are inspected to see whether they are operating normally by using the first to the tenth call lights 201 to 210 described above.

The first to the sixth loudspeakers 101 to 106 are sequentially caused to output an inspection tone, and each is inspected to see whether it is operating normally. At this time, in accordance with the inspection tone being outputted, the call lights which correspond to the loudspeakers from which the inspection tone is outputted are turned on.

Figure 2:
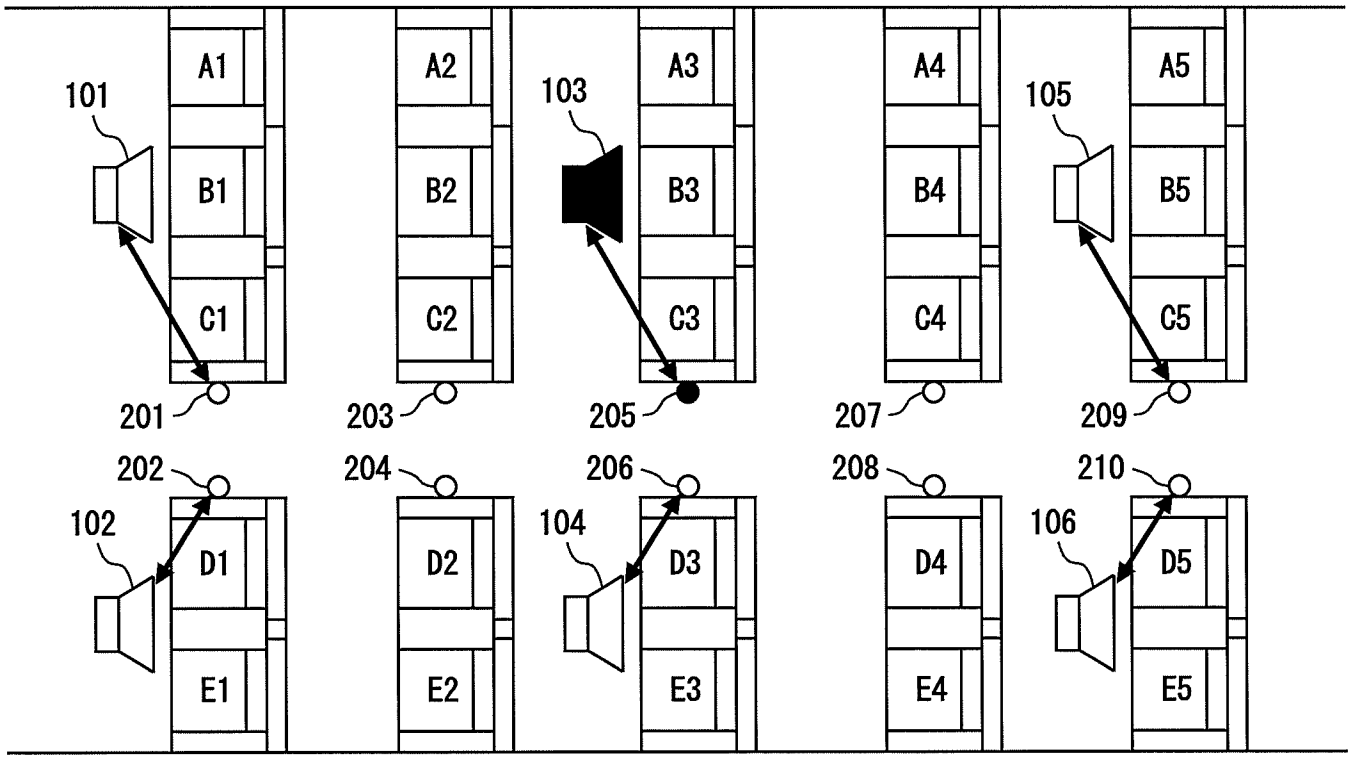
FIG. 2 shows a relationship between the loudspeakers and the call lights at a time of inspection.

FIG. 2 shows a relationship between the loudspeakers and the call lights at a time of inspection. In FIG. 2, the first loudspeaker 101, the second loudspeaker 102, the third loudspeaker 103, the fourth loudspeaker 104, the fifth loudspeaker 105, and the sixth loudspeaker 106 are associated with the first call light 201, the second call light 202, the fifth call light 205, the sixth call light 206, the ninth call light 209, and the tenth call light 210, respectively.

For example, when the third loudspeaker 103 is caused to output an inspection tone and is inspected to see whether it is operating normally, the fifth call light 205 is turned on in accordance with the inspection tone being outputted.

For example, assume a case where the third loudspeaker 103 is malfunctioning. In this case, an inspector cannot perceive an inspection tone at all even though the fifth call light 205 is turned on. The inspector thereby perceives easily that the third loudspeaker 103 which corresponds to the fifth call light 205 is malfunctioning.

Further, a loudspeaker control apparatus that controls operations of the loudspeakers and the call lights will be described in detail while switching between the normal mode and the inspection mode.

Figure 3:
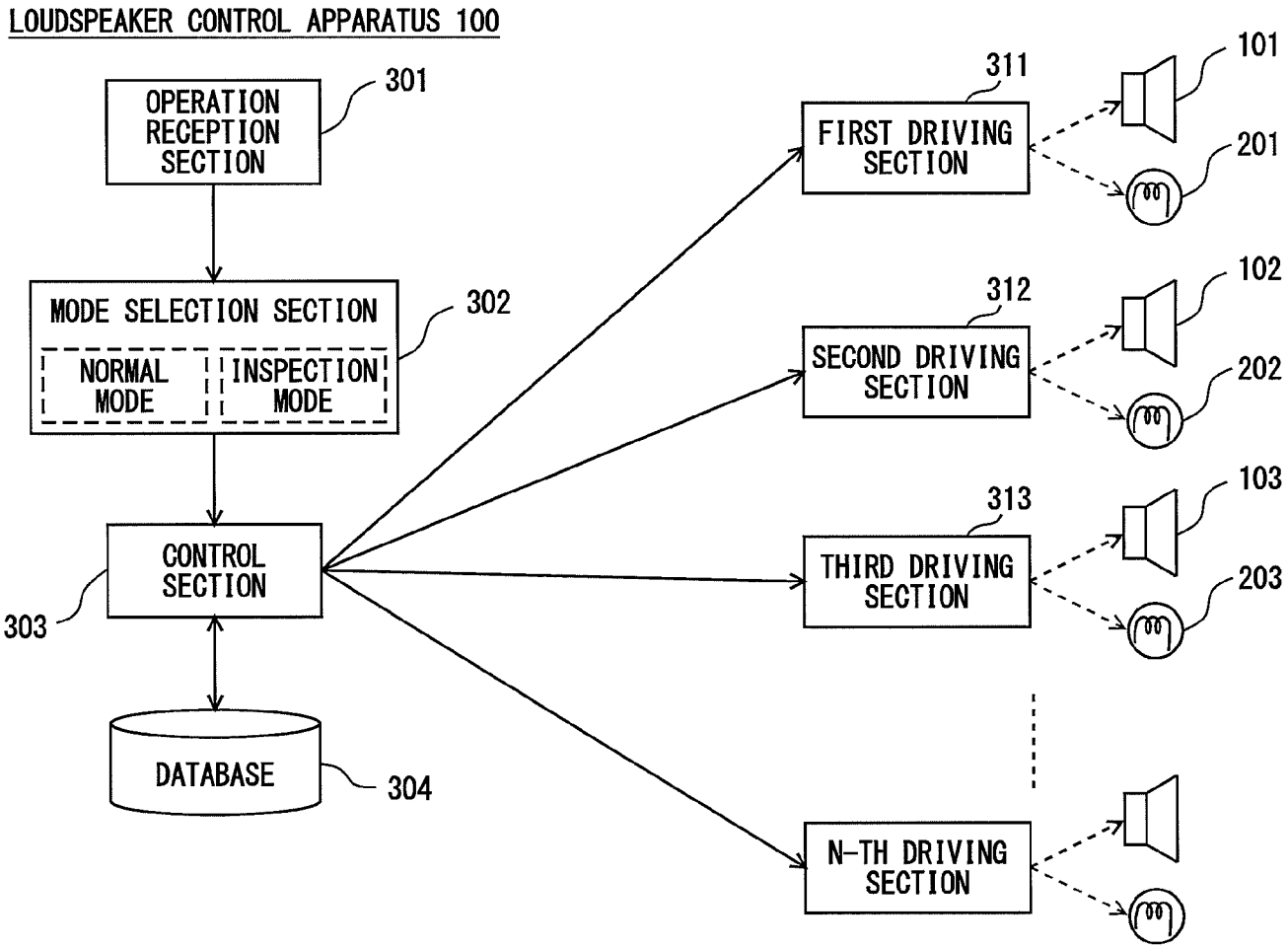
FIG. 3 is a functional block diagram showing a loudspeaker control apparatus 100 according to one embodiment of the present invention.

FIG. 3 is a functional block diagram showing a loudspeaker control apparatus 100 according to one embodiment of the present invention. In FIG. 3, the loudspeaker control apparatus 100 includes an operation reception section 301, a mode selection section 302, a control section 303, a database 304, a plurality of driving sections (here, a first driving section 311, a second driving section 312, a third driving section 313 . . . , an N-th driving section), a plurality of loudspeakers (here, the first loudspeaker 101, the second loudspeaker 102, the third loudspeaker 103 . . . , an N-th loudspeaker), and a plurality of call lights (here, the first call light 201, the second call light 202, the third call light 203 . . . , an N-th call light).

The operation reception section 301 receives a user operation. Specifically, when the user inspects whether the plurality of loudspeakers provided in the airplane are operating normally, the user performs an operation of switching the operation mode from the normal mode to the inspection mode so that the loudspeaker control apparatus 100 operates in the inspection mode. The operation mode is switched from the inspection mode to the normal mode, for example, in a case where the loudspeakers provided in the airplane are inspected to see whether they are operating normally before passengers board the airplane.

Based on the user operation received by the operation reception section 301, the mode selection section 302 selects between the two operation modes, either the normal mode or the inspection mode. Here, the operation mode of the loudspeaker control apparatus 100 is switched from the normal mode to the inspection mode.

Based on the operation mode selected by the mode selection section 302, the control section 303 controls the operations of the plurality of loudspeakers and call lights. In the inspection mode, the control section 303 controls the first driving section 311 to cause the first loudspeaker 101 to output an inspection tone and to simultaneously turn on the first call light 201. Sequentially in the same manner, the control section 303 controls the second driving section 312 to cause the second loudspeaker 102 to output an inspection tone and to simultaneously turn on the second call light 202. Then, the control section 303 controls the third driving section 313 to cause the third loudspeaker 103 to output an inspection tone and to simultaneously turn on the third call light 203. Accordingly, the control section 303 sequentially causes the plurality of loudspeakers provided in the airplane to output an inspection tone and sequentially turns on the call lights which correspond to the respective loudspeakers from which the inspection tone is being outputted.

It should be note that the control section 303 is connected to each of the driving sections by an Ethernet (registered trademark) via, for example, a hub or the like. Each of the driving sections receives a loudspeaker inspection command from the control section 303 via the Ethernet, causes the corresponding loudspeaker to output an inspection tone, and simultaneously turns on the call light which corresponds to the loudspeaker from which the inspection tone is being outputted.

In the database 304, an association between loudspeakers from which an inspection tone is outputted in the inspection mode and call lights which correspond to the respective loudspeakers is stored. FIG. 4 shows an example of a database in which an association between loudspeakers and call lights is stored. In FIG. 4, an order of inspection; IP addresses of respective driving sections to which a loudspeaker inspection command is transmitted; port IDs of the respective loudspeakers to be inspected; and port IDs of the respective call lights to be turned on in accordance with the loudspeakers to be inspected are prestored in the database.

Here, the respective driving sections, loudspeakers, and call lights are uniquely specified by using the IP addresses and the port IDs; however, the present invention is not limited thereto. Any other information may be used as long as the information represents identification information that can uniquely specify the respective driving sections, loudspeakers, and call lights.

Further in the database, items such as: intervals (predetermined time period T1) at which a loudspeaker inspection command is transmitted to the respective driving sections; types and sizes (for example, frequency information, types of chime, setting of tone source on WAV files, and the like) of the inspection tone to be outputted from each of the loudspeakers; a time period T2 during which the inspection tone is to be outputted; and the like may be prestored.

Further, an inspection start command and an inspection finish command may be used as a loudspeaker inspection command. Specifically, an inspection start command causes a loudspeaker to be inspected to output an inspection tone and causes a call light corresponding to the loudspeaker from which the inspection tone is being outputted to be turned on. Then, when the time period T2 has elapsed, an inspection finish command causes the loudspeaker to stop to output the inspection tone and causes the call light to be turned off.

Typically, an inspector who checks whether each of loudspeakers is operating normally, alternately checks an inspection tone outputted from each of the loudspeakers and a corresponding call light to be turned on while moving along an aisle (between the seats in column C and the seats in column D in FIGS. 1 and 2) in an airplane. Therefore, the predetermined time period T1 and the time period T2 may be set to, for example, between several seconds and several tens of seconds, by taking into account a time taken for an inspector to check an inspection tone outputted from a loudspeaker and a call light to be turned on, and a speed of the inspector to move to a loudspeaker and a call light to be inspected next, and the like. In addition, the predetermined time period T1 and the time period T2 may be set by taking into account a size of an airplane, location of loudspeakers, and the like.

Figure 5:
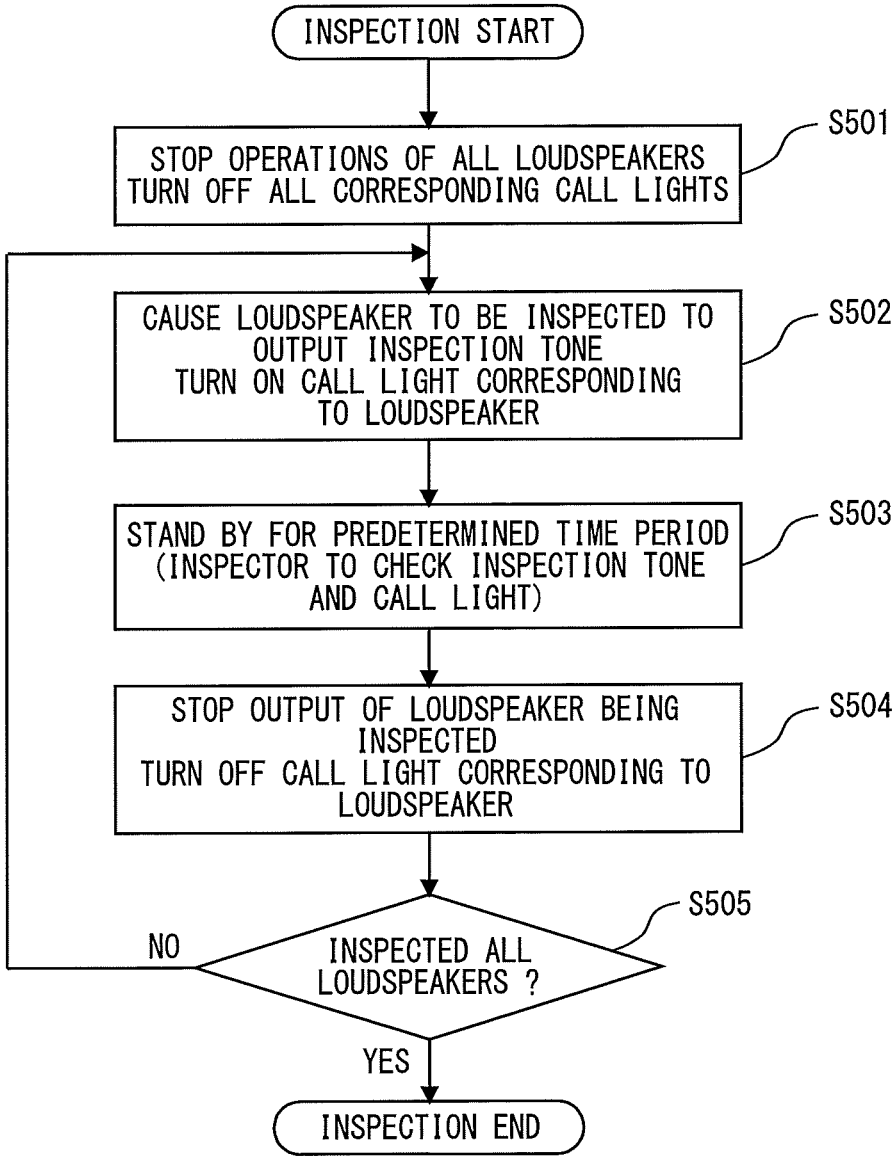
FIG. 5 is a flow chart showing a processing flow of a loudspeaker inspecting method 500 performed by the loudspeaker control apparatus 100 according to one embodiment of the present invention.

Next, a processing flow of a method for inspecting loudspeakers performed by the loudspeaker control apparatus 100 according to one embodiment of the present invention will be described in detail. FIG. 5 is a flow chart showing a processing flow of a loudspeaker inspecting method 500 performed by the loudspeaker control apparatus 100 according to one embodiment of the present invention.

First, on reception of a user operation for the inspection mode, the operation reception section 301 starts the processing of the loudspeaker inspecting method 500 (inspection start).

In step S501, as preprocessing, the control section 303 stops operations of all of loudspeakers and turns off all of call lights which correspond to loudspeakers to be inspected.

In step S502, the control section 303 causes a loudspeaker to be inspected to output an inspection tone and simultaneously turns on a call light which corresponds to the loudspeaker. Specifically, in accordance with an order stored in the database 304, the control section 303 transmits an inspection start command to a corresponding driving section. Consequently, an inspection tone is outputted from a corresponding loudspeaker to be inspected and a call light which corresponds to the loudspeaker is turned on simultaneously.

In step S503, the control section 303 stands by for a predetermined time period. Here, the predetermined time period is a time period during which an inspector checks an inspection tone from a loudspeaker being inspected and a call light which corresponds to the loudspeaker. To "stand by" means, for example, not to terminate inspection processing of a loudspeaker currently being inspected for the time period during which the inspector checks the loudspeaker, or not to shift the inspection processing from the loudspeaker currently being inspected to a loudspeaker to be inspected next.

At this time, while the inspector checks an inspection tone from the loudspeaker being inspected, if the inspector perceives an abnormal tone or the inspector cannot perceive an inspection tone, for example, the inspector can easily specify which loudspeaker among a plurality of loudspeakers provided in the airplane is not operating normally based on a call light having been turned on, which corresponds to the loudspeaker.

In step S504, the control section 303 causes the loudspeaker being inspected to stop to output the inspection tone and simultaneously turns off the call light which corresponds to the loudspeaker. Specifically, the control section 303 transmits an inspection finish command to the driving section to which the control section 303 has transmitted the inspection start command in step S502. Consequently, the output of the inspection tone from the loudspeaker being inspected is stopped and the call light which corresponds to the loudspeaker is turned off simultaneously.

It should be noted that a timing at which the control section 303 transmits an inspection start command in step S502, a timing at which the control section 303 transmits an inspection finish command in step S504, a time period during which an inspection tone is to be outputted, and a time period during which a call light remains turned on are prestored in the database 304, and the control section 303 performs processing with reference to the database 304.

In step S505, the control section 303 determines whether all of the loudspeakers to be inspected have been inspected. When all of the loudspeakers to be inspected have been inspected (Yes in step S505), the processing of the loudspeaker inspecting method 500 is terminated (inspection end). Meanwhile, when not all of the loudspeakers to be inspected have been inspected (No in step S505), the processing returns to step S502, and the control section 303 performs inspection of a loudspeaker to be inspected next.

It should be noted that since the preprocessing has been performed for all of the loudspeakers and all of the call lights which correspond to the loudspeakers to be inspected in step S501, when the processing of the loudspeaker inspecting method 500 is terminated (inspection end), they may be restored to their states immediately prior to the inspection start.

As described above, in the loudspeaker control apparatus 100 and the loudspeaker inspecting method 500 according to one embodiment of the present invention, because a plurality of loudspeakers provided in an airplane can be inspected by using call lights which are regularly used, a light source or the like is not required for inspection. Thus, even after the loudspeakers are provided in the airplane, it is possible to inspect easily whether the loudspeakers are operating normally in a short time.

Further, in the loudspeaker control apparatus 100 according to one embodiment of the present invention, inspection procedure and inspection information including such as loudspeakers to be inspected, call lights which correspond to the loudspeakers, an order of inspection, types of inspection tone, a time period for checking inspection results, and the like are managed in the database 304. Thus, for example, in cases where: an arrangement of seats, loudspeakers and call lights in an airplane is changed; the number of loudspeakers to be inspected is increased/decreased; and types of inspection tone are changed, there is no need to correct an inspection program (software) executed by the control section 303 and it is only necessary to update the information stored in the database 304.

It should be noted that, in the loudspeaker control apparatus 100 according to one embodiment of the present invention, the above-described inspection procedure and inspection information and the like are collectively managed in the database 304; however, the present invention is not limited thereto. For example, in a database to which the control section 303 refers, only information of each driving section to which a loudspeaker inspection command is transmitted may be stored and each driving section may retain information of loudspeakers to be inspected and call lights which correspond to the loudspeakers.

Figure 6:
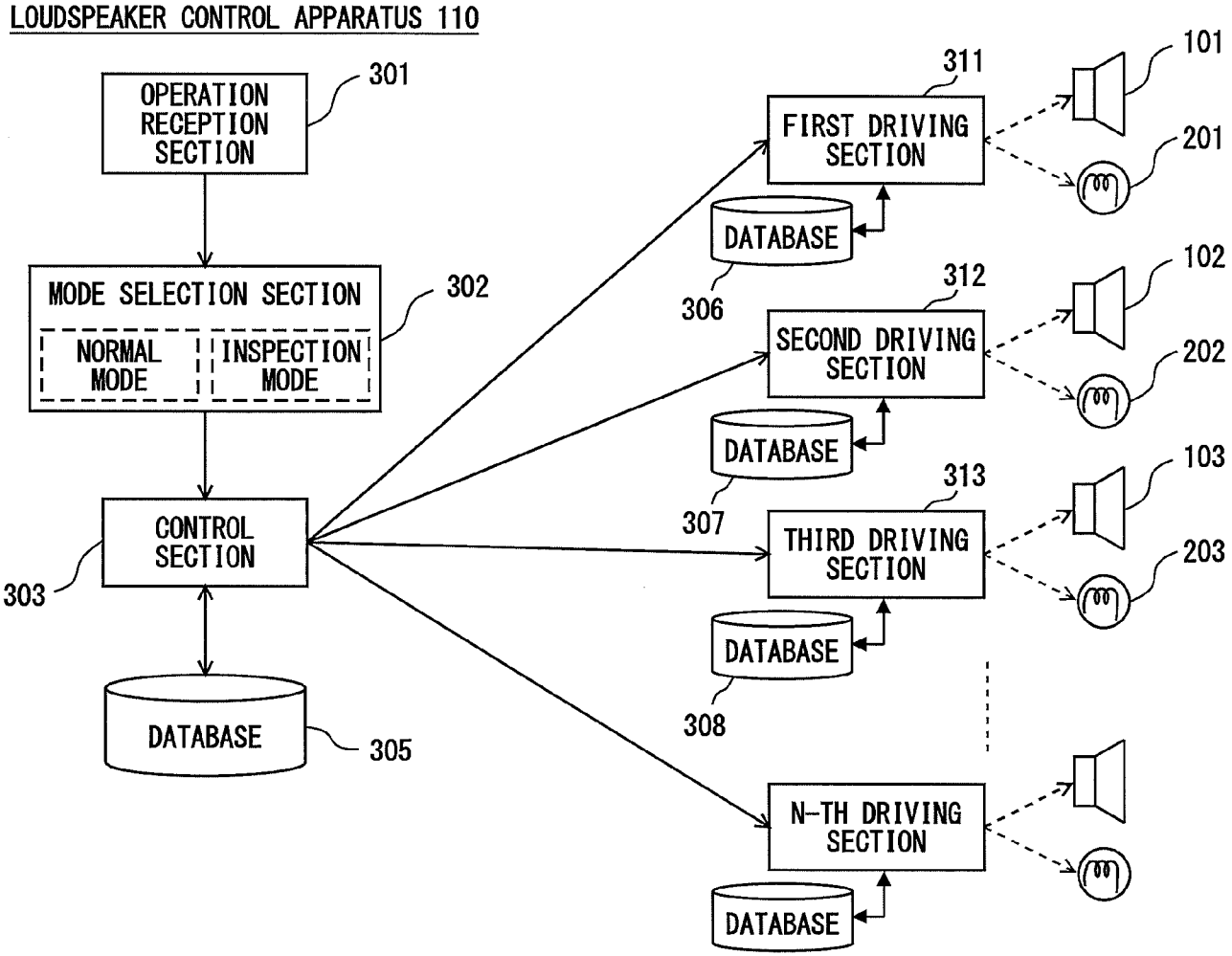
FIG. 6 is a functional block diagram of a loudspeaker control apparatus 110 according to an embodiment of the present invention.

FIG. 6 is a functional block diagram of a loudspeaker control apparatus 110 according to one embodiment of the present invention. In FIG. 6, the loudspeaker control apparatus 110 includes the operation reception section 301, the mode selection section 302, the control section 303, a database 305, a plurality of driving sections, a plurality of databases (here, databases 306, 307, 308 . . . ) included in the plurality of driving sections, respectively, a plurality of loudspeakers, and a plurality of call lights.

The loudspeaker control apparatus 110 has basically the same configuration as that of the loudspeaker control apparatus 100 shown in FIG. 3, and thus components the same as those in FIG. 3 are denoted by the same reference numerals and detailed descriptions thereof will be omitted.

In the inspection mode, the control section 303 controls the first driving section 311 to cause the first loudspeaker 101 to output an inspection tone and to simultaneously turn on the first call light 201. Here, in the database 305 to which the control section 303 refers, information regarding the first driving section 311 is stored. For example, in the database 305, IP addresses of the respective driving sections to which a loudspeaker inspection command is transmitted, an order and a timing to transmit the loudspeaker inspection command, and the like may be stored.

Then, for example, on receipt of a loudspeaker inspection command, the first driving section 311 refers to the database 306 and causes the first loudspeaker 101 to be inspected to output an inspection tone and turns on the first call light 201 which corresponds to the first loudspeaker 101. At this time, in the database 306 to which the first driving section 311 refers, information regarding the first loudspeaker 101 and the first call light 201 is stored. For example, in the database 306, port IDs of the first loudspeaker 101 and the first call light 201 are stored and a type and a volume of inspection tone to be outputted from the first loudspeaker 101, and the like may be further stored.

Also in each of the other databases included in the respective driving sections (the databases 307, 308 and the like in FIG. 6), information regarding a loudspeaker and a call light which correspond to each of the driving sections is stored.

As described above, in the loudspeaker control apparatus 110 according to one embodiment of the present invention, each driving section includes a database for storing information regarding a loudspeaker to be inspected and a call light which corresponds to the loudspeaker. Accordingly, for example, in such a case where a malfunctioning loudspeaker is replaced, it is only necessary to update the database in which the information regarding the loudspeaker is stored, and there is no need to correct an inspection program (software) executed by the control section 303 or other databases.

Further, in one embodiment of the present invention, an inspection tone is outputted from a loudspeaker to be inspected and a call light which corresponds to the loudspeaker is turned on simultaneously, thereby allowing an inspector to specify which loudspeaker among a plurality of loudspeakers provided in an airplane is not operating normally; however, the light to be turned on is not limited to a call light. For example, the light may be a reading light provided in each seat in the airplane. A reading light is a light used by each passenger seated in a seat when the passenger needs to illuminate a spot at a hand level, for example, when he/she reads.

Figure 7:
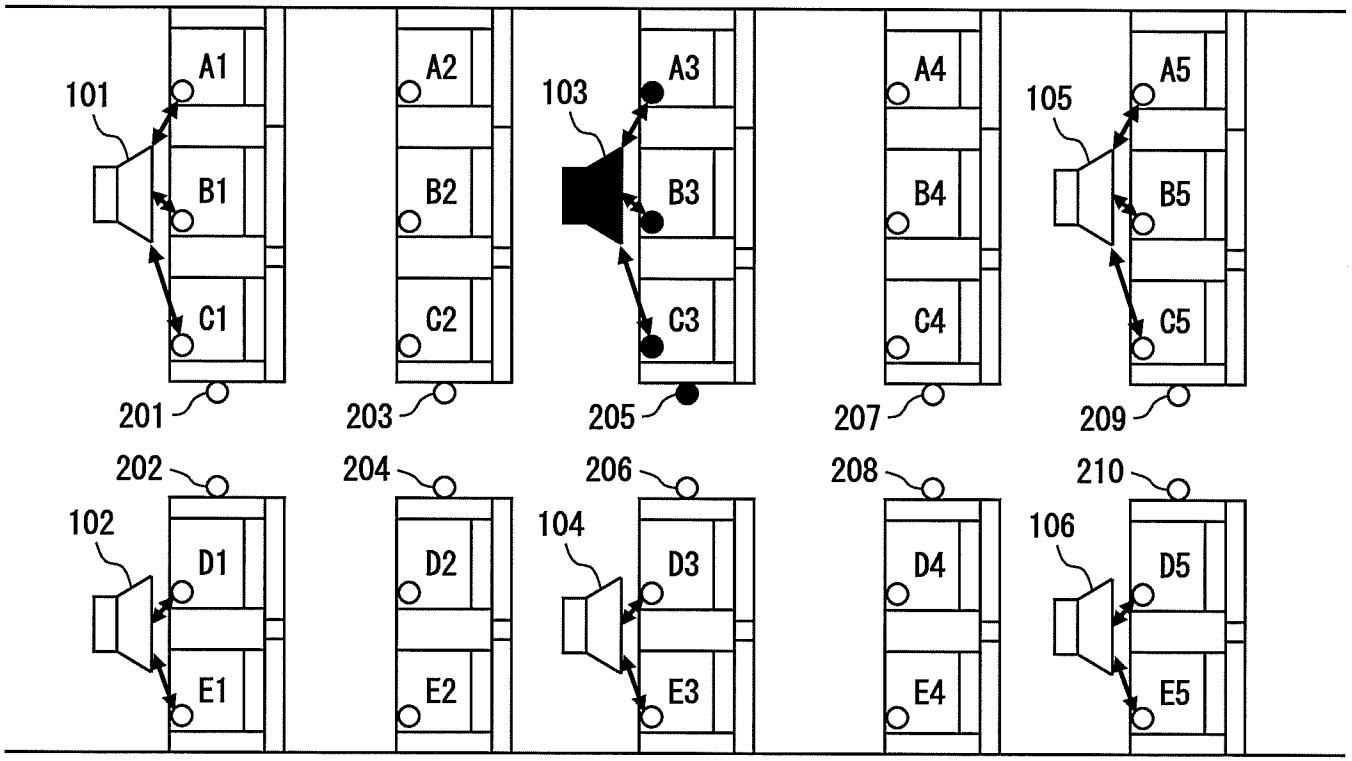
FIG. 7 is a schematic diagram showing an arrangement example of seats, loudspeakers, call lights, and reading lights in an airplane.

FIG. 7 is a schematic diagram showing an arrangement example of seats, loudspeakers, call lights, and reading lights in an airplane. In FIG. 7, the reading lights are provided in the seats, respectively. The first loudspeaker 101, the second loudspeaker 102, the third loudspeaker 103, the fourth loudspeaker 104, the fifth loudspeaker 105, and the sixth loudspeaker 106 are associated with reading lights provided in seats A1, B1, C1, reading lights provided in seats D1, E1, reading lights provided in seats A3, B3, C3, reading lights provided in seats D3, E3, reading lights provided in seats A5, B5, C5, and reading lights provided in seats D5, E5, respectively.

For example, when the third loudspeaker 103 is caused to output an inspection tone and is inspected to see whether it is operating normally, the reading lights provided in the seats A3, B3, C3 are turned on in accordance with the inspection tone being outputted.

For example, assume a case where the third loudspeaker 103 is malfunctioning. In this case, even if the reading lights provided in the seats A3, B3, C3, respectively are turned on, an inspector cannot perceive an inspection tone at all and thus can easily perceive that the third loudspeaker 103 which corresponds to the reading lights provided in the seats A3, B3, C3 is malfunctioning.

Here, two or three reading lights are turned on for one loudspeaker. However, for a loudspeaker, a single reading light provided in the closest seat to the loudspeaker may be turned on.

Alternatively, a call light shown in FIG. 2 and a reading light shown in FIG. 7 may be turned on for one loudspeaker.

Still alternatively, the light is not limited to a call light and/or a reading light as far as a method is used in which a loudspeaker outputting an inspection tone can be identified from among a plurality of loudspeakers provided in an airplane. For example, the call light and/or the reading light may be caused to blink. Alternatively, other lights provided in the airplane may be used.

A light such as a call light and/or a reading light provided in an airplane are used for allowing an inspector to identify a loudspeaker outputting an inspection tone; however, another method may be used as far as it is a method which can identify a loudspeaker outputting an inspection tone. For example, location or an identification number of a loudspeaker outputting an inspection tone may be displayed on a monitor, which an inspector can check.

In one embodiment of the present invention, as shown in FIGS. 1, 2, and 7, a medium-sized or a small-sized airplane is described as an example, in which the seats are configured in a 3+2 column formation. However, application of the present invention is not limited thereto. For example, numbers and an arrangement of seats, loudspeakers, call lights, reading lights, and a monitor may vary depending on a size and a type of an airplane. The present invention is applicable also to a bus, a train, and a conference room in which loudspeakers are provided indoors.

As described above, a loudspeaker control apparatus of the present invention which controls operations of a plurality of loudspeakers and lights provided indoors, includes: an operation reception section that receives a user operation: a mode selection section that selects between two operation modes, based on the user operation received by the operation reception section, either a normal mode in which the operations of the plurality of loudspeakers and lights are controlled independently or an inspection mode in which each of the plurality of loudspeakers is inspected to see whether it is operating normally; and a control section that controls the operations of the plurality of loudspeakers and lights based on the operation mode selected by the mode selection section, and the control section, in the inspection mode, sequentially causes the plurality of loudspeakers to output an inspection tone and, in accordance with the inspection tone being outputted, sequentially causes lights which correspond to the loudspeakers from which the inspection tone is being outputted to be turned on or to blink.

Preferably, the loudspeaker control apparatus of the present invention may further include a database in which the loudspeakers from which the inspection tone is outputted in the inspection mode and the lights which correspond to the loudspeakers are stored.

Further, typically in the loudspeaker control apparatus of the present invention, lights which correspond to the loudspeakers from which the inspection tone is outputted are at least one or more lights which are provided in the vicinity of the loudspeakers.

Further, in the loudspeaker control apparatus of the present invention, call lights closest to the respective loudspeakers are included among the lights which correspond to the loudspeakers from which the inspection tone is outputted.

Further, in the loudspeaker control apparatus of the present invention, reading lights closest to the respective loudspeakers are included among the lights which correspond to the loudspeakers from which the inspection tone is outputted.

As described above, the loudspeaker inspection method of the present invention is performed by a loudspeaker control apparatus that controls operations of a plurality of loudspeakers and lights provided indoors, including the steps of: receiving a user operation; selecting between two operation modes, based on the user operation received in the user operation receiving step, either a normal mode in which the operations of the plurality of loudspeakers and light are controlled independently or an inspection mode in which each of the plurality of loudspeakers is inspected to see whether it is operating normally; and controlling the operations of the plurality of loudspeakers and lights based on the operation mode selected in the operation mode selecting step, and the controlling step, in the inspection mode, sequentially causes the plurality of loudspeakers to output an inspection tone and, in accordance with the inspection tone being outputted, sequentially causes lights which correspond to the loudspeakers from which the inspection tone is being outputted to be turned on or to blink.

Further, in order to achieve the above objective, the process steps performed by the respective components of the loudspeaker control apparatus of the present invention may be viewed as a loudspeaker inspection method which provides a series of procedures. This method is provided in a form of a program to cause a computer to perform the series of procedures. The program may be recorded in a computer-readable recording medium to be introduced to the computer.

The present invention is useful for a loudspeaker control apparatus, and the like, that controls operations of a plurality of loudspeakers provided indoors.

While the invention has been described in detail, the foregoing description is in all aspects illustrative and not restrictive. It will be understood that numerous other modifications and variations can be devised without departing from the scope of the invention.

What is claimed is:

1. A loudspeaker control apparatus that controls operations of a plurality of loudspeakers and lights provided indoors, the apparatus comprising:

an operation reception section that receives a user operation:

a mode selection section that selects between two operation modes, based on the user operation received by the operation reception section, either a normal mode in which the plurality of loudspeakers and lights are caused to operate in non-cooperation with each other, or an inspection mode in which each of the plurality of loudspeakers is inspected to see whether it is operating normally by causing each of the plurality of the loudspeakers and one or more lights to operate in cooperation with each other; and a control section that controls the operations of the plurality of loudspeakers and lights based on the operation mode selected by the mode selection section, wherein the control section, in the inspection mode, sequentially causes the plurality of loudspeakers to output an inspection tone and, in accordance with the inspection tone being outputted, sequentially causes the one or more lights which correspond to each of the plurality of the loudspeakers from which the inspection tone is being outputted to be turned on or to blink.

2. The loudspeaker control apparatus according to claim 1, further comprising a database in which the loudspeakers from which the inspection tone is outputted in the inspection mode and the lights which correspond to the loudspeakers are stored.

3. The loudspeaker control apparatus according to claim 2, wherein the lights which correspond to the loudspeakers from which the inspection tone is outputted are at least one or more lights, which are provided in the vicinity of the loudspeakers.

4. The loudspeaker control apparatus according to claim 3, wherein call lights closest to the respective loudspeakers are included among the lights which correspond to the loudspeakers from which the inspection tone is outputted.

5. The loudspeaker control apparatus according to claim 3, wherein reading lights closest to the respective loudspeakers are included among the lights which correspond to the loudspeakers from which the inspection tone is outputted.

6. A loudspeaker inspection method performed by a loudspeaker control apparatus that controls operations of a plurality of loudspeakers and lights provided indoors, the method comprising the steps of:

receiving a user operation;

selecting between two operation modes, based on the user operation received in the user operation receiving step, either a normal mode in which the plurality of loudspeakers and light are caused to operate in non-cooperation with each other, or an inspection mode in which each of the plurality of loudspeakers is inspected to see whether it is operating normally by causing each of the plurality of the loudspeakers and one or more lights to operate in cooperation with each other; and controlling the operations of the plurality of loudspeakers and lights based on the operation mode selected in the operation mode selecting step, wherein the controlling step, in the inspection mode, sequentially causes the plurality of loudspeakers to output an inspection tone and, in accordance with the inspection tone being outputted, sequentially causes the one or more lights which correspond to each of the plurality of the loudspeakers from which the inspection tone is being outputted to be turned on or to blink.

* * * * *